US009550653B2

(12) United States Patent
Wesson et al.

(10) Patent No.: US 9,550,653 B2
(45) Date of Patent: Jan. 24, 2017

(54) ELEVATOR TENSION MEMBER

(75) Inventors: John P. Wesson, Vernon, CT (US); Huan Zhang, Glastonbury, CT (US); Gopal R. Krishnan, Wethersfield, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 130 days.

(21) Appl. No.: 14/113,451

(22) PCT Filed: Jun. 10, 2011

(86) PCT No.: PCT/US2011/039896

§ 371 (c)(1),
(2), (4) Date: Oct. 23, 2013

(87) PCT Pub. No.: WO2012/170031

PCT Pub. Date: Dec. 13, 2012

(65) Prior Publication Data

US 2014/0076669 A1 Mar. 20, 2014

(51) Int. Cl.

| | |
|---|---|
| ***B66B 7/06*** | (2006.01) |
| ***D02G 3/32*** | (2006.01) |
| *D07B 1/22* | (2006.01) |

(52) U.S. Cl.

CPC ..... *B66B 7/06* (2013.01); *B66B 7/062* (2013.01); *D02G 3/32* (2013.01); *D07B 1/22* (2013.01);

(Continued)

(58) Field of Classification Search

CPC .... B66B 7/06; B66B 7/062; D07B 2501/2007
See application file for complete search history.

(56) References Cited

U.S. PATENT DOCUMENTS

| | | | |
|---|---|---|---|
| 3,584,516 | A | 6/1971 | Burpulis et al. |
| 4,154,335 | A | 5/1979 | Burnett et al. |

(Continued)

FOREIGN PATENT DOCUMENTS

| | | | |
|---|---|---|---|
| CN | 1188567 | C | 2/2005 |
| CN | 201546108 | U | 8/2010 |

(Continued)

OTHER PUBLICATIONS

International Search Report and Written Opinion for Corresponding International Application No. PCT/US2011/039896 filed Jun. 10, 2011; report date Jan. 19, 2012.

(Continued)

*Primary Examiner* — Michael Mansen
*Assistant Examiner* — Diem Tran
(74) *Attorney, Agent, or Firm* — Cantor Colburn LLP

(57) ABSTRACT

Elevator tension members are disclosed. The disclosed tension member longitudinally extends along a longitudinal axis and includes a plurality of fibers formed into one or more primary strands or cords extending parallel to the longitudinal axis and a plurality of fibers formed into one or more secondary strands or cords extending parallel to the longitudinal axis and through less than the full length of the belt, and a jacket retaining the primary and secondary strands or cords. The secondary strands or cords have a tensile modulus greater than a tensile modulus of the jacket and less than a tensile modulus of the primary strands or cords. Methods of making the tension member are also disclosed.

19 Claims, 7 Drawing Sheets

(52) U.S. Cl.
CPC ..... *D07B 2201/2087* (2013.01); *D07B 2501/2007* (2013.01)

(56) References Cited

U.S. PATENT DOCUMENTS

| | | | | |
|---|---|---|---|---|
| 4,526,637 | A | 7/1985 | Long | |
| 4,813,533 | A | 3/1989 | Long | |
| 6,095,321 | A | 8/2000 | Striegl et al. | |
| 6,250,456 | B1 | 6/2001 | Striegl et al. | |
| 6,260,692 | B1 | 7/2001 | Sashide et al. | |
| 6,314,711 | B1 * | 11/2001 | De Angelis | 57/210 |
| 6,358,171 | B1 | 3/2002 | Whitfield | |
| 6,390,242 | B1 | 5/2002 | Baranda | |
| 6,672,046 | B1 | 1/2004 | Prewo et al. | |
| 6,739,433 | B1 | 5/2004 | Baranda | |
| 7,828,121 | B2 | 11/2010 | Parrini | |
| 2004/0016603 | A1 * | 1/2004 | Aulanko et al. | 187/254 |
| 2004/0026676 | A1 | 2/2004 | Smith | |
| 2004/0110441 | A1 | 6/2004 | Parrini | |
| 2004/0206579 | A1 | 10/2004 | Baranda et al. | |
| 2004/0231312 | A1 * | 11/2004 | Honda | 57/241 |
| 2006/0070822 | A1 | 4/2006 | Osada et al. | |
| 2007/0062762 | A1 | 3/2007 | Ach | |
| 2008/0041667 | A1 | 2/2008 | Aulanko et al. | |
| 2008/0223665 | A1 | 9/2008 | O'Donnell | |
| 2008/0277206 | A1 | 11/2008 | Veronesi et al. | |
| 2009/0126296 | A1 * | 5/2009 | Veronesi et al. | 52/223.1 |
| 2009/0314584 | A1 * | 12/2009 | Smith et al. | 187/247 |
| 2014/0305744 | A1 * | 10/2014 | Kere et al. | 187/254 |
| 2014/0345978 | A1 * | 11/2014 | Alasentie et al. | 187/254 |

FOREIGN PATENT DOCUMENTS

| | | | |
|---|---|---|---|
| JP | 2009274798 | A | 11/2009 |
| JP | 2009292630 | A | 12/2009 |
| WO | WO 00/35785 | | 6/2000 |
| WO | WO 01/14630 | A1 | 3/2001 |
| WO | WO 01/83337 | A1 | 11/2001 |
| WO | WO 2006075384 | A1 * | 7/2006 |
| WO | WO 2009/114104 | A1 | 9/2007 |
| WO | WO 2008/058413 | A1 | 5/2008 |
| WO | WO 2008/147884 | A2 | 12/2008 |
| WO | WO 2009/011998 | A1 | 1/2009 |
| WO | WO 2010/056247 | A1 | 5/2010 |
| WO | WO 2010/081935 | A1 | 7/2010 |
| WO | WO 2012056529 | A1 * | 5/2012 |

OTHER PUBLICATIONS

Search report for related European Application No. 11867104.9; report dated Oct. 10, 2014.
Chinese Second Office Action and Search Report for application CN 2011800715117, Issued Nov. 9, 2015, 10 pages.

* cited by examiner

6/76/7

ELEVATOR TENSION MEMBER

CROSS-REFERENCE TO RELATED APPLICATIONS

This application is a U.S. national stage filing under 35 USC §371 of international Patent Application No. PCT/US2011/039896, filed Jun. 10, 2011.

BACKGROUND

Technical Field

The present disclosure is directed to tension members such as those used in elevator systems for suspension and/or driving of the elevator car and/or counterweight.

Description of the Related Art

Traction elevators are widely used. In general, a traction elevator system can include a car, a counterweight, one or more tension members interconnecting the car and counterweight, a traction sheave to move the tension member, and a motor-driven machine to rotate the traction sheave. The sheave is formed from cast iron.

In some elevators, the tension member is a rope formed from twisted steel wires. In other elevators, the tension member is a belt with the twisted wires retained in a polymer jacket. In any event, the transfer of the propulsive load between the sheave and the tension member requires coupling of shear forces along the contact length between the sheave and the tension member. With a belt as the tension member, if the shearing force exceeds the total pullout strength along the contact length, the jacket may crack, deform, or even separate from the belt.

In general, a conventional elevator tension member can include a plurality of steel wires of specific number, size and geometry for purposes of strength, cost of production, and/or durability. The polymer jacket used to retain the steel wires is usually made of polyurethane or other suitable polymer materials. However, as the tensile strength of steel is significantly higher than that of polyurethane, the polymer jacket may be susceptible to premature wear under the aforementioned shear forces, especially along the contact length between the steel wire and the iron sheave.

One way to address this issue is to reinforce the jacket with secondary tension members. For example, one elevator belt is known as including a plurality of planar steel cords encased in a polyurethane jacket, which is reinforced with a plurality of polymer cords distributed throughout the entire jacket. Moreover, each polymer cord is extending through the entire length of the belt. While effective in providing reinforcement to the elevator belt, the polymer cords may increase bending stiffness and may cause localized stress concentration, either of which may adversely affect the performance or service life of the elevator belt. Moreover, the polymer cords distributed throughout the entire jacket may increase the production cost and production time of the elevator belt.

Some power transmission belts, such as timing belts or serpentine belts in automobiles, includes interwoven reinforcement fibers encased in a polymer jacket. Such designs are labor intensive and consume more material, but are necessary for the strength of the belt due to the lack of stronger primary tension members (e.g. steel wires) in the power transmission belts.

SUMMARY OF THE DISCLOSURE

In the present application, a tension member for an elevator system is disclosed. The tension member longitudinally extends along a longitudinal axis and includes a plurality of fibers formed into one or more primary strands or cords extending parallel to the longitudinal axis and a plurality of fibers formed into one or more secondary strands or cords extending along the longitudinal axis and through less than the full length of the belt. The secondary strands or cords have a tensile modulus greater than a tensile modulus of the jacket and less than a tensile modulus of the primary strands or cords. The tension member further includes a jacket at least substantially retaining the primary and secondary strands or cords.

Alternatively in this or other aspects of the invention, the tensile modulus of the secondary strands or cords is at least ten times the tensile modulus of the jacket.

Alternatively in this or other aspects of the invention, the tensile modulus of the primary strands or cords is about 10-100 times of the tensile modulus of the secondary strands or cords.

Alternatively in this or other aspects of the invention, the jacket is made of polyurethane and the primary strands or cords are made of steel.

Alternatively in this or other aspects of the invention, the secondary strands or cords are made of aramid, such as para-aramid.

Alternatively in this or other aspects of the invention, each and every primary strand or cord is positioned within a primary tension zone and each and every secondary tension strand or cord is positioned outside of the primary tension zone.

Alternatively in this or other aspects of the invention, the primary tension zone is defined by two imaginary planes parallel and equidistant to the longitudinal axis of the tension member.

Alternatively in this or other aspects of the invention, all of the primary strands or cords are coplanar.

Alternatively in this or other aspects of the invention, the secondary strands or cords are located on one side of the primary tension zone.

Alternatively in this or other aspects of the invention, the secondary strands or cords are located on both sides of the primary tension zone.

Alternatively in this or other aspects of the invention, the tension member is in frictional contact with a traction sheave of an elevator system. The elevator system may further include a driving machine to rotate the traction sheave.

Alternatively in this or other aspects of the invention, each of the secondary strands or cords is longer than the contact length between the tension member and traction sheave of the elevator system.

Alternatively in this or other aspects of the invention, the elevator system includes a driving machine to rotate the traction sheave.

Alternatively in this or other aspects of the invention, the tension member extends between an elevator car and a counterweight A method of forming an elevator tension member extending along a longitudinal axis is also disclosed. In a general embodiment, the method includes the steps of arranging a plurality of primary strands or cords along the longitudinal axis; arranging a plurality of secondary strands or cords along the longitudinal axis; and at least substantially retaining the primary and secondary strands or cords in a jacket. The secondary strands or cords are shorter than the primary strands or cords and extending less than the full length of the belt, and the secondary strands or cords have a tensile modulus greater than a tensile modulus of the jacket and less than a tensile modulus of the primary strands or cords.

Alternatively in this or other aspects of the invention, the secondary strands or cords are retained in the jacket before the primary strands or cords.

Alternatively in this or other aspects of the invention, the primary strands or cords are retained in the jacket before the secondary strands or cords.

Alternatively in this or other aspects of the invention, the primary strands or cords are retained in a first portion of the jacket and the secondary strands or cords are retained in a second portion of the jacket before the first and second portions of the jacket are fused together to form the tension member.

Finally, an elevator system is disclosed as including a traction sheave and a tension member engaging said traction sheave along a distance. The tension member longitudinally extends along a longitudinal axis and includes a plurality of fibers formed into one or more primary strands or cords extending parallel to the longitudinal axis, a plurality of fibers formed into one or more secondary strands or cords extending parallel to the longitudinal axis, and a jacket at least substantially retaining the primary and secondary strands or cords. The secondary strands or cords have a tensile modulus greater than a tensile modulus of the jacket and less than a tensile modulus of the primary strands or cords. The primary strands or cords have a length substantially greater than said distance and said secondary strands or cords have a length approximately equal to said distance.

Other advantages and features of the disclosed elevator tension member and method of making thereof will be described in greater detail below. It will also be noted here and elsewhere that the device or method disclosed herein may be suitably modified to be used in a wide variety of applications by one of ordinary skill in the art without undue experimentation.

BRIEF DESCRIPTION OF THE DRAWINGS

For a more complete understanding of the disclosed device and method, reference should be made to the embodiments illustrated in greater detail in the accompanying drawings, wherein.

It should be understood that the drawings are not necessarily to scale and that the disclosed embodiments are sometimes illustrated diagrammatically and in partial views. In certain instances, details which are not necessary for an understanding of the disclosed device or method which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
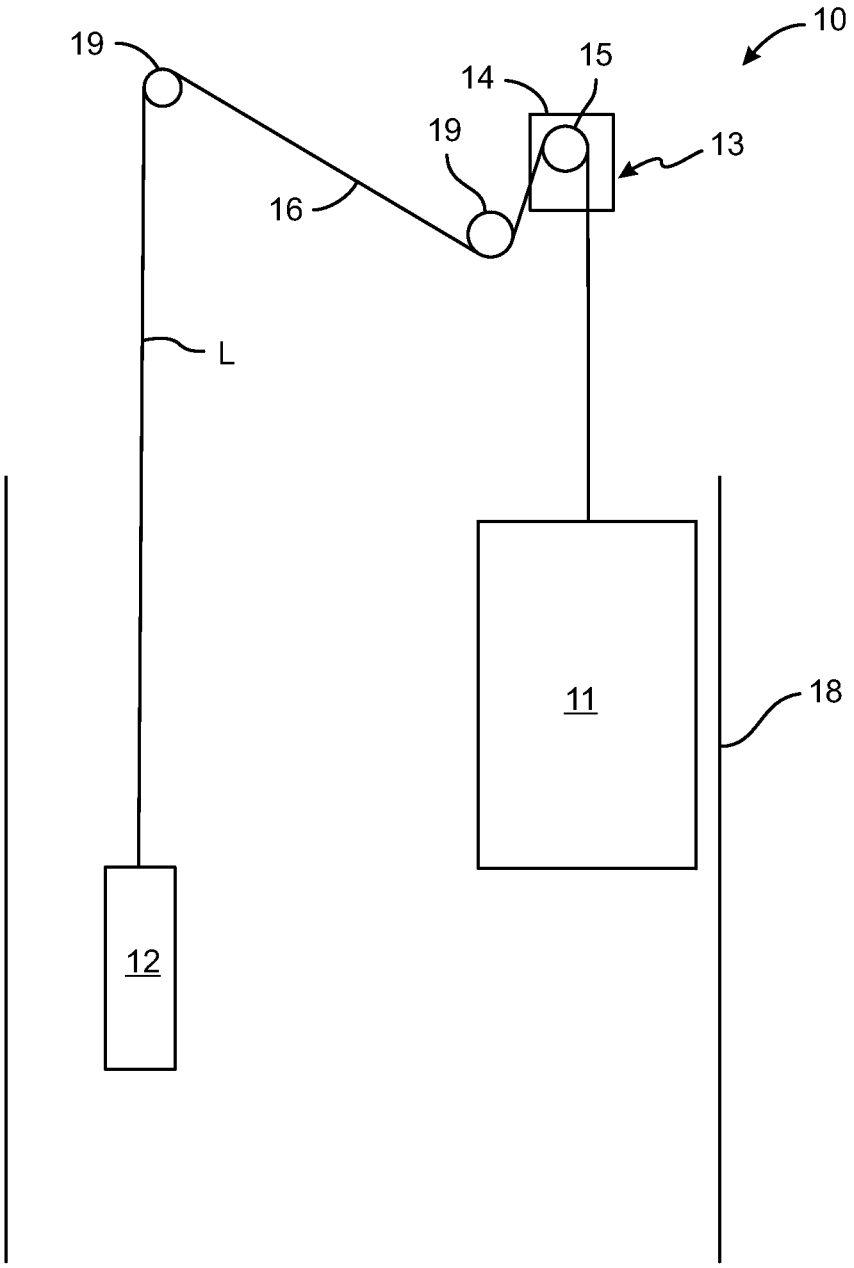
FIGS. 1-3 are side views of various exemplary elevator systems that could use a tension member according to one aspect of the present disclosure.
Figure 2:
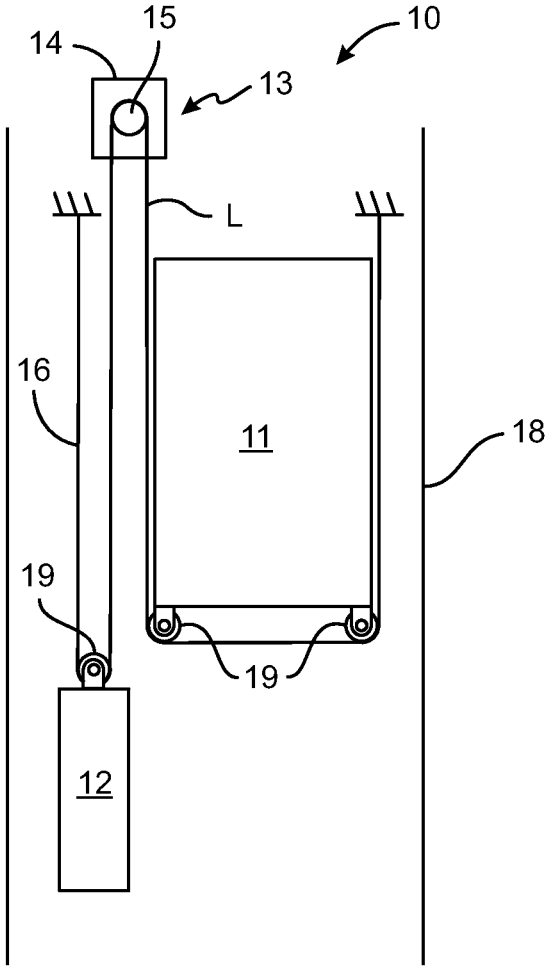
Figure 3:
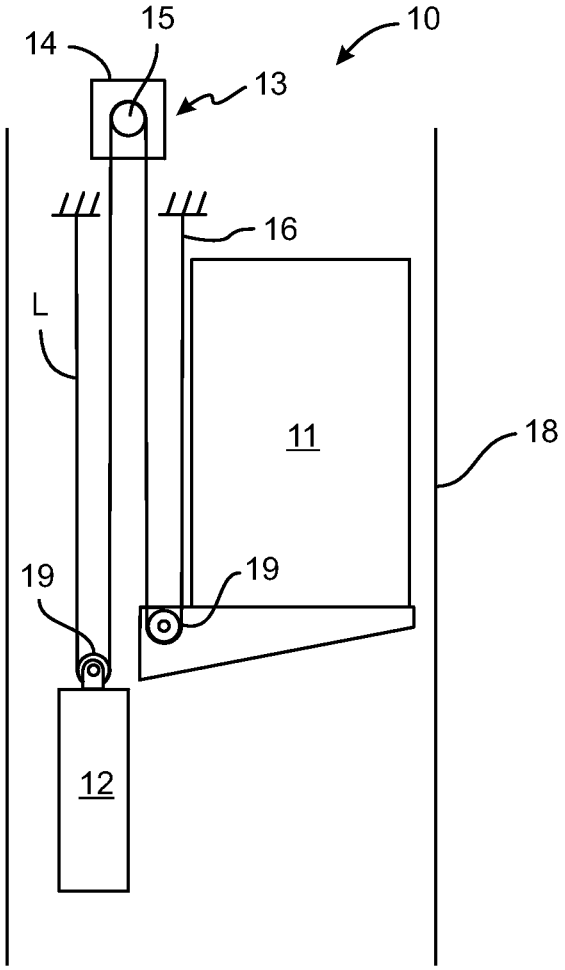
Figure 5:
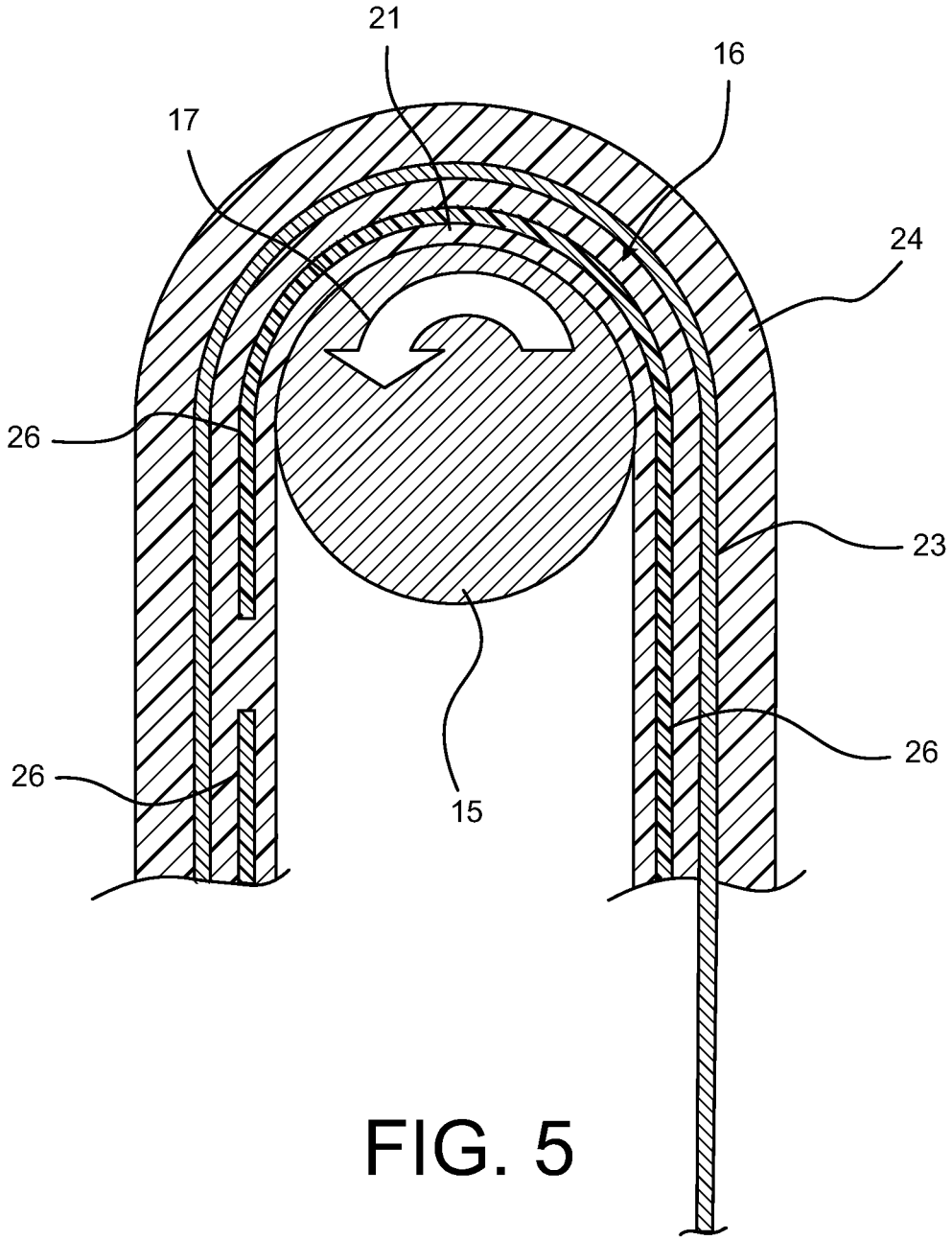
FIG. 5 is a partial side view of the tension members in FIGS. 1-3, particularly illustrating the discontinuity of the secondary strands or cords.

FIGS. 1-3 illustrate various exemplary arrangements of a traction elevator system 10. Features of the elevator system 10 that are not required for an understanding of the present invention (such as the guide rails, safeties, etc.) are not discussed herein. The elevator system 10 can include a car 11 operatively suspended or supported in a hoistway 18 with one or more tension members 16, such as coated ropes or belts. The tension member 16 could also suspend or support a counterweight 12 that helps balance the elevator system 10 and maintain tension on the tension member 16 on both sides of a traction sheave 15 during operation. The elevator system 10 can also include a traction drive 13 that includes a machine 14 in operative connection with the traction sheave 15. The tension member 16 is engaged with the sheave 15 (and possibly one or more additional diverter, deflector or idler sheaves 19) such that rotation of the sheave 15 drives, moves or propels the tension member 16 (through traction), thereby raising or lowering the car 11 and/or counterweight 12. To that end, the sheave 15 includes a traction surface 21 that engages a traction surface 17 of the tension member 16 (as best shown in FIG. 5). The machine 14 may include an electrical motor and could be gearless or have a geared transmission.

FIG. 1 provides a 1:1 roping arrangement in which the one or more tension members 16 terminate at the car 11 and counterweight 12. FIGS. 2-3 show that the car 11 and/or the counterweight 12 could have one or more additional sheaves 19 thereon engaging the one or more tension member 16 and the one or more tension member 16 can terminate elsewhere, typically at a structure within the hoistway 18 (such as for a machineroomless elevator system) or within the machine room (for elevator systems utilizing a machine room). The number of additional sheaves 19 used in the arrangement determines the specific roping ratio (e.g. the 2:1 ratio shown in FIGS. 2-3 or a different ratio). Furthermore, FIG. 3 provides a so-called rucksack or cantilevered type elevator system. As should now be understood, a variety of elevator systems could utilize the present invention.

Figure 4:
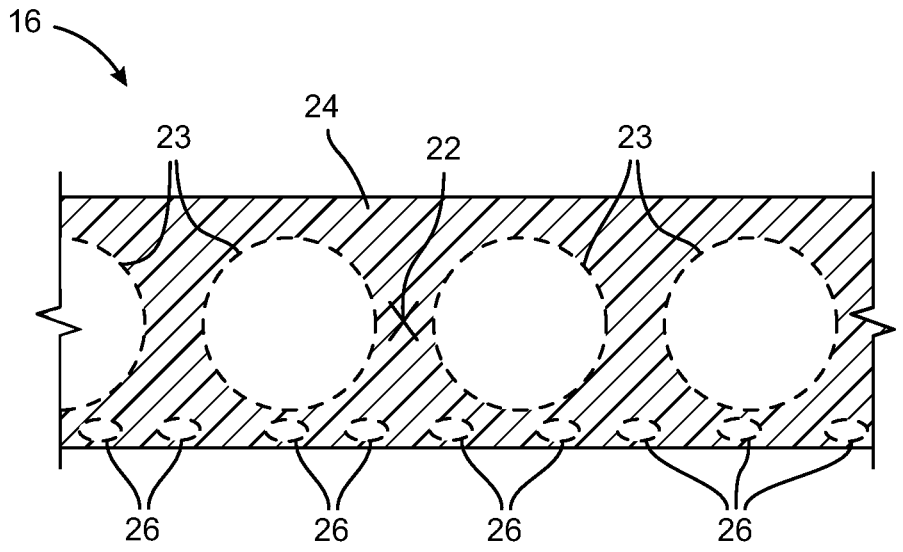
FIG. 4 is a sectional partial side view of the tension members in FIGS. 1-3, particularly illustrating the primary and secondary strands or cords.

Turning to FIG. 4, the tension member 16 may include one or more strands or cords (23, 26) at least substantially retained in a jacket 24. The tension member may be in the form of a coated rope or belt. A "coated rope" refers to a tension member having an aspect ratio (defined as width/thickness) of about 1, such as a tension member with one cord 23 in a jacket 24. A "coated belt" refers to a tension member having an aspect ratio of greater than 1, such as a tension member with two or more cords 23 in a jacket 24.

The phrase "substantially retained" means that the jacket 24 has sufficient engagement with the strands or cords (23, 26) such that the strands or cords (23, 26) do not pull out of, detach from, and/or cut through the jacket 24 during the application on the tension member 16 of a load that can be encountered during use in the elevator system 10. In other words, the strands or cords (23, 26) remain at their original positions relative to the jacket 24 during use in an elevator system 10. The jacket 24 could completely encase/envelop the strands or cords (23, 26) (such as shown in FIG. 4), substantially encase/envelop the strands or cords (23, 26), or at least partially encase/envelop the strands or cords (23, 26).

Still referring to FIG. 4, the tension member 16 may include one or more load-bearing primary strands or cords 23 retained in a jacket 24. As seen in FIG. 4, the tension member 16 can have an aspect ratio greater than one (i.e. tension member width is greater than tension member thickness). The primary strands or cords 23 can extend through an entire length of the tension member and along a longitudinal axis 22 of the tension member 16. Each of the primary strands or cords 23 may include a plurality of load bearing fibers 25 that are twisted, braided, or otherwise bunched together. In one embodiment, at least some of the load-bearing fibers 25 are formed of metal, such as a carbon steel, with properties which enable the steel to be drawn. A typical steel may have a medium carbon content resulting in drawn strength in the range of between about 1800 and about 3300 MPa. The steel may be cold drawn and/or galvanized for the recognized properties of strength and corrosion resistance of such processes. The primary strands or cords 23 of the tension member 16 could all be identical, or some or all of the primary strands or cords 23 used in the belt 16 could be different than the other strands or cords 23. For example, one or more of the strands or cords 23 could have a different construction or size than the other strands or cords 23.

The jacket 24 may be formed of any suitable material, including a single material, multiple materials, two or more layers using the same or dissimilar materials, and/or a film. In one arrangement, the jacket 24 could be a polymer, such as an elastomer like a thermoplastic polyurethane material applied to the primary strands or cords 23 using, for example, an extrusion or a mold wheel process. Other materials may also be used to make the jacket 24, provided that strength and durability of such materials are sufficient to meet the required functions of the tension member, including traction, wear, transmission of traction loads to the one or more primary strands cords 23 and resistance to environmental factors. The jacket 24 may also contain a fire retardant composition. In addition, the composite tensile properties of the secondary cords or fibers and the jacket are expected to be enhanced over the properties of an unsupported jacket. In this manner, jacket materials with insufficient properties to meet all belt properties, but with other desirable properties, such as damping or fire retardancy, can be made to provide sufficient properties for use in an elevator belt.

In accordance with one aspect of this disclosure, the tension member 16 includes a plurality of secondary strands or cords 26 retained in the jacket 24. As illustrated in FIG. 4, the secondary strands or cords 26 also extend along the longitudinal axis 22 of the tension member 16. Without wishing to be bound by any particular theory, it is contemplated that the composite tensile strength, composite tensile modulus and/or the service life of the tension member 16 may be improved by the secondary strands or cords 26 having specific characteristics and/or positioned at specific locations as disclosed in greater detail below. Moreover, the secondary strands or cords 26 used in the present disclosure may provide reinforcement to the tension member 16 while avoiding the high cost, complex construction, bending stiffness, and/or localized stress concentration associated with known reinforcement structures. With the secondary strands or cords 26, the jacket 24 can substantially retain the primary strands or cords 23 therein. As a result, the jacket 24 has sufficient engagement with the primary strands or cords 23 such that the primary strands or cords 23 do not pull out of, detach from, and/or cut through the jacket 24 during the application on the belt 16 of a load that can be encountered during use in an elevator system 10 with, potentially, an additional factor of safety. In other words, the primary strands or cords 23 remain at their original positions relative to the jacket 24 during use in an elevator system 10.

One feature of the tension member 16 in some embodiments of this disclosure is that the secondary strands or cords 26 may have a tensile modulus greater than that of the jacket 24 and less than that of the primary strands or cords 23. In one non-limiting embodiment, the tensile modulus of the secondary strands or cords 26 is at least about ten times or even at least about 100 times of the tensile modulus of the jacket 24. In another non-limiting embodiment, the tensile modulus of the primary strands or cords 23 is from about 1.5 to about 3 times of the tensile modulus of the secondary strands or cords 26.

As a non-limiting example, the secondary strands or cords 26 may be made of an aromatic polyamide material, such as aramids. Aramids are generally prepared by the reaction between an amine group and a carboxylic acid halide group. Simple AB homopolymers may formed through the following reaction:

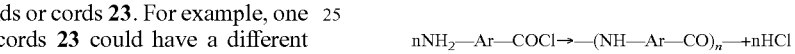

$$nNH_2—Ar—COCl \rightarrow —(NH—Ar—CO)_n— + nHCl$$

The most well-known commercial aramids are Kevlar®, Twaron®, Nomex®, New Star®, Teijinconex® and X-fiper®, all of which are AABB-type polymers. Among those aramids, Nomex®, Teijinconex®, New Star and X-Fiper® contain predominantly the meta-linkage and are poly-metaphenylene isophtalamides (MPIA). On the other hand, Kevlar® and Twaron® are both p-phenylene terephtalamides (PPTA), the simplest form of the AABB-type para-polyaramide. PPTA is a product of p-phenylene diamine (PPD) and terephtaloyl dichloride (TDC or TCl). In one embodiment of the present application, the secondary cords are formed of Kevlar®. The tensile modulus of steel (exemplary material for the primary cords), Kevlar® (exemplary material for the secondary cords), and thermoplastic polyurethane (exemplary material for the jacket) are listed in Table 1 below.

TABLE 1

Tensile Modulus of Materials Used in the Tension member

| Structural Component | Primary Cords | Secondary Cords | Jacket |
|---|---|---|---|
| Exemplary Material | Steel | Kevlar ® | Thermoplastic Polyurethane |
| Tensile Modulus (GPa) | 200 | 70.5-112.4 | 0.069-0.69 |

Referring now to FIG. 5, another feature of the tension member 16 in some embodiments of this disclosure is that the secondary strands or cords 26 do not extend through the full length L of the tension member 16. In fact, the average length of the secondary strands or cords 26 may be less than the full length L of the tension member, e.g. less than 20%, 10% or even 5% of L. To provide sufficient reinforcement to the jacket 24, however, each of the secondary strands or cords 26 could be longer than the contact length between the tension member 16 and sheave 15. As an example, an arrangement in which the wrap angle is approximately 180°, the contact length between the tension member 16 and the sheave 15 may be approximately half of the outer circumference of the sheave 15. It is the inventors of the present application who unexpectedly discovered that by tailoring the secondary strands or cords 26 to the length disclosed herein, the tensile strength, tensile modulus and/or the service life of the tension member 16 may be improved without the high cost, complex construction, relatively high bending stiffness, and/or localized stress concentration associated with known reinforcement structures, an insight heretofore unknown.

Figure 6:
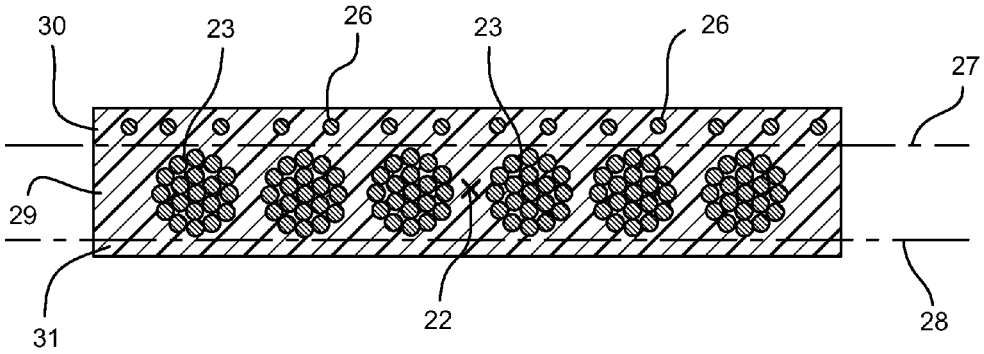
FIG. 6 is a cross sectional view of a first embodiment of the tension members in FIGS. 1-4, particularly illustrating the location and distribution of the secondary strands or cords.
Figure 7:
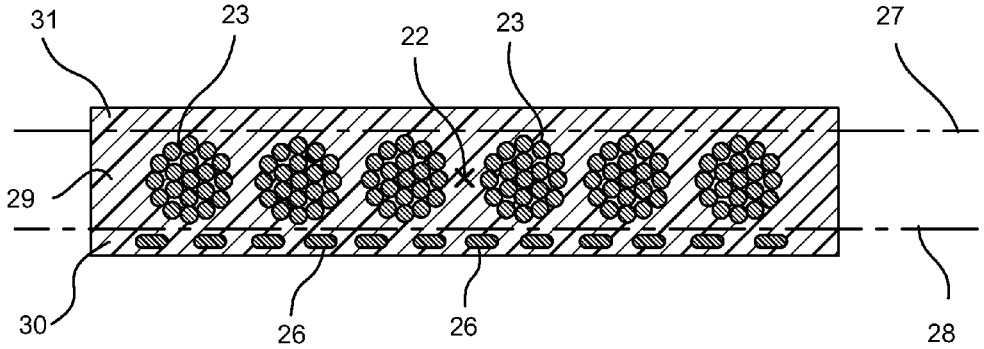
FIG. 7 is a cross sectional view of a second embodiment of the tension members in FIGS. 1-4, particularly illustrating the location and distribution of the secondary strands or cords.
Figure 8:
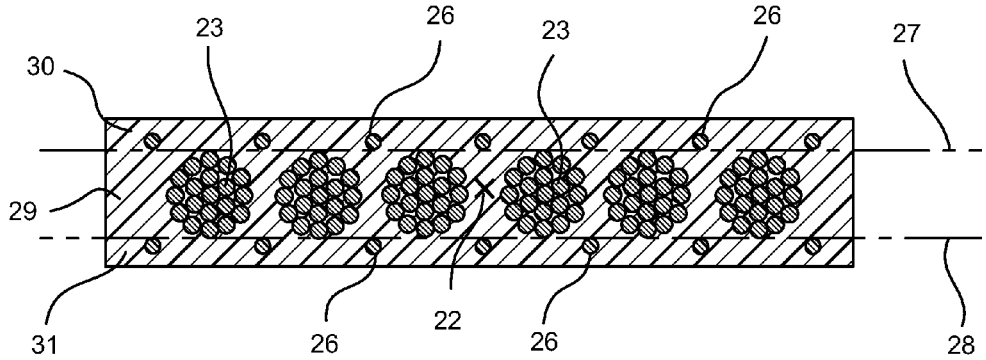
FIG. 8 is a cross sectional view of a third embodiment of the tension members in FIGS. 1-4, particularly illustrating the location and distribution of the secondary strands or cords.

In addition to the material and length of the secondary strands or cords 26 used in the tension member 16, the configuration (position and distribution) of the secondary strands or cords 26 within the jacket 24 may also contribute to the desirable features of the disclosed tension member 16. FIGS. 6-8 illustrate some non-limiting exemplary configurations, in which the tension member 16 is divided by two imaginary planes (27, 28) into a primary tension zone 29 sandwiched between two secondary tension zones (30, 31). The two imaginary planes (27, 28) are parallel and equidistant to the longitudinal axis 22 of the tension member 16.

Referring now to FIG. 6, the tension member 16 includes a plurality of coplanar primary strands or cords 23 located within the primary tension zone 29. The tension member 16 also includes a plurality of coplanar secondary strands or cords 26 with circular cross-sectional profiles positioned outside of the primary tension zone 29. In this embodiment, all of the secondary strands or cords 26 are positioned within the secondary tension zone 30, while the other secondary tension zone 31 does not include any secondary strand or cord. It is to be understood that neither the primary strands or cords 23 nor the secondary strands or cords 26 need to have the coplanar configuration illustrated in FIG. 6, as long as all of the primary strands or cords 23 are located within the primary tension zone 29 and all of the secondary strands or cords 26 are located outside of the primary tension zone 29.

FIG. 7 illustrates a configuration similar to FIG. 6 except that the secondary strands or cords 26 there have a relatively flat cross-sectional profile. As the secondary strands or cords 26 in FIGS. 6-7 are located in only one of the two secondary tension zones (30, 31), the tension members 16 in those embodiments are preferably mounted on the sheave 15 so that the secondary tension zone 30 reinforced with the secondary strands or cords 26 faces the traction surface 21 of the sheave 15.

Turning now to FIG. 8, the tension member 16 includes a plurality of coplanar primary strands or cords 23 located within the primary tension zone 29. The tension member 16 also includes a plurality of secondary strands or cords 26 with circular cross-sectional profiles located outside of the primary tension zone 29. Unlike in FIGS. 6-7, the secondary strands or cords 26 in this embodiment are located on both sides of the primary tension zone 29, with some of the secondary strands or cords 26 located on the secondary tension zone 30 and the rest located on the secondary tension zone 31. One feature of this configuration is that the tension member 16 includes two reinforced tension zones (30, 31) and thus can be mounted on the sheave 15 with either secondary tension zone facing the traction surface 21 of the sheave 15 and that the tension member 16 may be flipped periodically to further extend the service life of the tension member 16.

It is to be understood that the cross-sectional profiles of the secondary strands or cords 26 illustrated in FIGS. 6-8 should not be interpreted as limiting the scope of the present application. For example, the cross-sectional profile of the secondary strands or cords 26 may also be oval, square, rectangular or other suitable overall cross-sectional profiles. Moreover, each of the secondary strands or cords 26 may consist of a single polymer fiber in some embodiments, or a strand of polymer fibers twisted, braided, or otherwise bunched together.

Further, although the jacket 24 is illustrated in FIGS. 6-8 as having an overall rectangular cross-sectional profile, it is to be understood that other cross-sectional profiles of the jacket 24 may also be possible in light of this disclosure. For example, the jacket 24 may have circular, oval, square, or other suitable overall cross-sectional profiles. Moreover, although the jacket 24 in FIGS. 4 and 6-8 is illustrated as retaining multiple primary strands or cords 23 and multiple secondary strands or cords 26, it is to be understood that the jacket 24 may also retain a single primary strand or cord 23 and/or a single secondary strands or cord 26. Other numbers of the primary strands or cords 23 and secondary strands or cords 26 may also be accommodated in the tension member 16 provided that the number of strands or cords (23, 26) does not adversely affect the performance, durability, and production cost of the tension member 16.

Without wishing to be bound by any particular theory, it is contemplated by the inventors of the present application that the localization of the primary and secondary cords to distinct tension zones as disclosed herein, the tensile strength and/or the service life of the tension member 16 may be improved without the high cost, complex construction, relatively high bending stiffness, and/or localized stress concentration associated with known reinforcement structures, an insight heretofore unknown.

In addition, the tension member 16 disclosed in the present application includes secondary strands or cords 26 that are mechanically isolated from one another. In other words, the shear force exerted on each secondary strands or cord 26 is not transferred to adjacent secondary cords through interweaved structures as in automobile timing belts and serpentine belts. As a result of such a non-interference configuration, the tension member 16 according to this disclosure can be made with less material, through a simpler manufacturing process, and in a shorter period of time.

Figure 9:
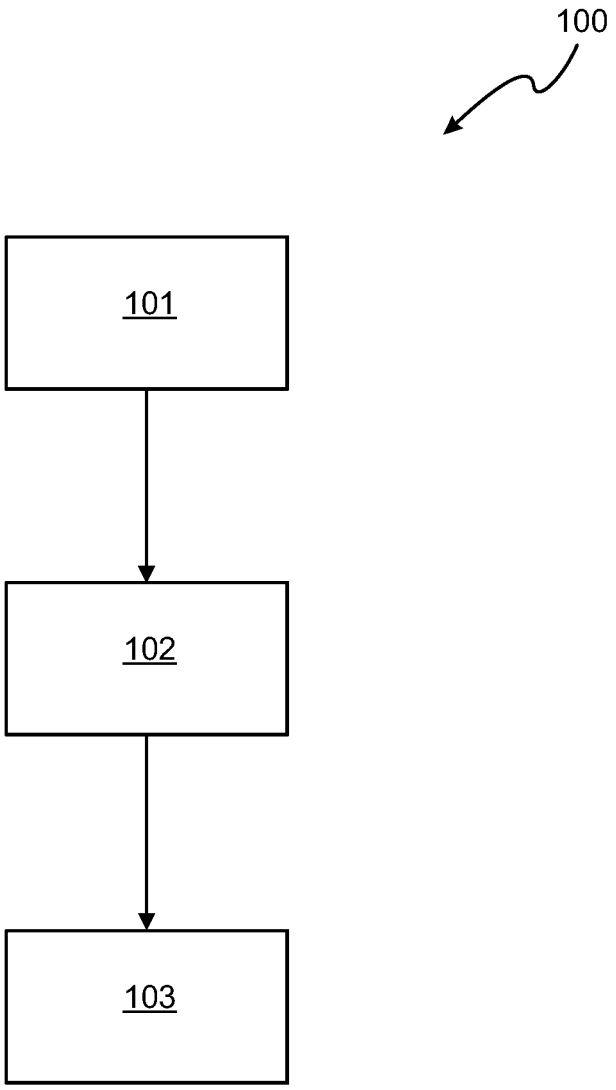
FIG. 9 is a block diagram of a method of making the tension members in FIGS. 4-8 according to another aspect of the present disclosure.

Referring now to FIG. 9, a method of forming an elevator tension member extending along a longitudinal axis 100 is also disclosed. In a general embodiment, the method includes the steps of arranging a plurality of primary strands or cords along the longitudinal axis 101; arranging a plurality of secondary strands or cords along the longitudinal axis 102; and at least substantially retaining the primary and secondary strands or cords in a jacket 103. The secondary strands or cords are shorter than the primary strands or cords and extending less than the full length of the belt. Moreover, the secondary strands or cords have a tensile modulus greater than a tensile modulus of the jacket and less than a tensile modulus of the primary strands or cords.

In one embodiment, the secondary cords are introduced into the thermoplastic polyurethane before the polyurethane is extruded onto the primary cords. In another embodiment, thermoplastic polyurethane is extruded onto the primary cords before the secondary cords are introduced to form the final tension member product. In yet another embodiment, thermoplastic polyurethane is extruded separately onto the primary and secondary cords before the two jacketed cords are thermally fused together. Other manufacturing method may also be used in light of this disclosure.

INDUSTRIAL APPLICABILITY

The tension member and method of making thereof disclosed herein may have a wide range of industrial, commercial or household applications. The tension cord may be conveniently installed in existing elevator systems without significant modifications thereto. Moreover, as discussed above, the tensile strength and/or the service life of the tension member 16 may be improved without the high cost, complex construction, bending stiffness, and/or localized stress concentration associated with known reinforcement structures.

While only certain embodiments have been set forth, alternative embodiments and various modifications will be apparent from the above descriptions to those skilled in the art. These and other alternatives are considered equivalents and within the spirit and scope of this disclosure.

What is claimed is:

1. A tension member for an elevator system, the tension member longitudinally extending along a longitudinal axis and comprising:

a plurality of fibers formed into one or more primary strands or cords extending parallel to the longitudinal axis;

a plurality of fibers formed into one or more secondary strands or cords extending along the longitudinal axis and through less than a full length of the tension member; and a jacket at least substantially retaining the one or more primary and one or more secondary strands or cords, the one or more secondary strands or cords having a tensile modulus greater than a tensile modulus of the jacket and less than a tensile modulus of the one or more primary strands or cords, the jacket having a jacket width and jacket thickness, the jacket width greater than the jacket thickness;

wherein each and every of the one or more primary strands or cords is positioned within a primary tension zone and each and every of the one or more secondary tension strands or cords is positioned outside of the primary tension zone;

wherein the primary tension zone is defined by two imaginary planes parallel and equidistant to a center axis of the tension member, the two imaginary planes being parallel to a surface of the jacket corresponding to the jacket width.

2. The tension member of claim 1, wherein the tensile modulus of the one or more secondary strands or cords is at least about ten times the tensile modulus of the jacket.

3. The tension member of claim 2, wherein the tensile modulus of the one or more primary strands or cords is about 10-100 times of the tensile modulus of the one or more secondary strands or cords.

4. The tension member of claim 2, wherein the jacket is made of polyurethane and wherein the one or more primary strands or cords are made of steel.

5. The tension member of claim 2, wherein the one or more secondary strands or cords are made of aramid.

6. The tension member of claim 5, wherein the aramid is a para-aramid.

7. The tension member of claim 1, wherein all of the one or more primary strands or cords are coplanar.

8. The tension member of claim 1, wherein the one or more secondary strands or cords are located on one side of the primary tension zone.

9. The tension member of claim 1, wherein the one or more secondary strands or cords are located on both sides of the primary tension zone.

10. An elevator system comprising a traction sheave in frictional contact with the tension member of claim 1.

11. The elevator system of claim 10, wherein each of the one or more secondary strands or cords is longer than a contact length between the tension member and traction sheave.

12. The elevator system of claim 10, further comprising a driving machine that rotates the traction sheave.

13. The elevator system of claim 12, wherein the tension member extends between an elevator car and a counterweight.

14. A method of forming an elevator tension member extending along a longitudinal axis, the method comprising:

arranging primary strands or cords along the longitudinal axis;

arranging secondary strands or cords along the longitudinal axis; and at least substantially retaining the primary and secondary strands or cords in a jacket, the secondary strands or cords being shorter than the primary strands or cords and extending less than a full length of the belt, and the secondary strands or cords having a tensile modulus greater than a tensile modulus of the jacket and less than a tensile modulus of the primary strands or cords, the jacket having a jacket width and jacket thickness, the jacket width greater than the jacket thickness;

wherein each and every of the primary strands or cords is positioned within a primary tension zone and each and every of the secondary tension strands or cords is positioned outside of the primary tension zone;

wherein the primary tension zone is defined by two imaginary planes parallel and equidistant to a center axis of the tension member, the two imaginary planes being parallel to a surface of the jacket corresponding to the jacket width.

15. The method of claim 14, wherein the primary strands or cords have a tensile modulus that is 10-100 times of a tensile modulus of the secondary strands or cords.

16. The method of claim 14, wherein the secondary strands or cords are retained in the jacket before the primary strands or cords.

17. The method of claim 14, wherein the primary strands or cords are retained in the jacket before the secondary strands or cords.

18. The method of claim 14, wherein the primary strands or cords are retained in a first portion of the jacket and the secondary strands or cords are retained in a second portion of the jacket before the first and second portions of the jacket are fused together to form the tension member.

19. An elevator system comprising:

a traction sheave; and a tension member engaging the traction sheave along a contact length, the tension member longitudinally extending along a longitudinal axis and comprising:

a plurality of fibers formed into one or more primary strands or cords extending parallel to the longitudinal axis;

a plurality of fibers formed into one or more secondary strands or cords extending parallel to the longitudinal axis; and a jacket at least substantially retaining the one or more primary strands or cords and the one or more secondary strands or cords, the one or more secondary strands or cords having a tensile modulus greater than a tensile modulus of the jacket and less than a tensile modulus of the one or more primary strands or cords, wherein the one or more primary strands or cords have a length greater than the contact length and the one or more secondary strands or cords have a length equal to the contact length the between tension member and traction sheave, the jacket having a jacket width and jacket thickness, the jacket width greater than the jacket thickness;

wherein each and every of the one or more primary strands or cords is positioned within a primary tension zone and each and every of the one or more secondary tension strands or cords is positioned outside of the primary tension zone;

wherein the primary tension zone is defined by two imaginary planes parallel and equidistant to a center axis of the tension member, the two imaginary planes being parallel to a surface of the jacket corresponding to the jacket width.

* * * * *